United States Patent [19]

Rovinsky

[11] Patent Number: 4,843,843

[45] Date of Patent: Jul. 4, 1989

[54] LINT-REMOVAL TUBING CHASE FOR A KNITTING MACHINE

[76] Inventor: William Rovinsky, 212 Haypath Rd., Old Bethpage, N.Y. 11804

[21] Appl. No.: 273,490

[22] Filed: Nov. 21, 1988

[51] Int. Cl.[4] ..... D04B 35/32

[52] U.S. Cl. ..... 66/168

[58] Field of Search ..... 66/168; 15/301

[56] References Cited

U.S. PATENT DOCUMENTS

| | | | |
|---|---|---|---|
| 2,846,860 | 8/1958 | Shortland | 66/168 |
| 3,269,151 | 8/1966 | Abrams | 66/168 |
| 3,422,640 | 1/1969 | Abrams | 66/168 |
| 4,691,536 | 9/1981 | Yorisue | 66/168 |
| 4,703,632 | 11/1987 | Izumi et al. | 66/168 |

*Primary Examiner*—Ronald Feldbaum

[57] ABSTRACT

A support structure having a pair of semi-circular members with a "C" shaped cross section which house a plurality of tubing which delivers air to a knitting machine to blow the lint therefrom.

3 Claims, 3 Drawing Sheets

LINT-REMOVAL TUBING CHASE FOR A KNITTING MACHINE

The present invention is for a knitting machine of the type requiring during its operation the effective removal, using pressure air, of lint, which will otherwise accumulate at the knitting stations of this machine and cause lint stubs and other such defects in the knitted fabric, and more particularly is concerned with an improved chase, and its installation, that is used for the tubing that supplies the pressure air for said lint removal.

The use of pressure air for lint removal, which is the specific prior art to which this invention is submitted as a significant advance, requires an air delivery system in the operation of which control is effectively exercised over the amount, duration of time, and other such parameters regarding the pressure air delivered to the lint-accumulation sites. A popular system uses lint-removing blowers which are each aimed at the lint-accumulation sites, and each of which has a tube connecting it to the pressure air source.

EXAMPLES OF THE PRIOR ART

In U.S. Pat. Nos. 2,522,183 and 2,538,659, respectively issued to Lawson on Sept. 12, 1950 and to Sharp on Jan. 16, 1951, there is illustrated and described chase constructions for the pressure air delivery tubes for the knitting machine lint-removing blowers. Undoubtedly because of the number of blowers required, and because each is connected by tubing to the pressure souce, the tubing chase is part of the overall permanent construction of the knitting machine, being located as it is required in order to have proximity to the blowers, below the knitting thread spools and above the knitting stations. As such, the tubing chase is not attached to the existing knitting machine, but is assembled as a part thereof, as the knitting machine is being constructed. That is, due to the complexity in handling plural tubes and pressure air fittings and the like, and its interposed position between the overhead knitting spools and the knitting stations beneath it, the typical prior art tubing chase was not an add-on attachment, but rather a component embodied during the construction of the knitting machine.

In contrast, the within inventive tubing chase, even though of a smaller diameter than the circular support for the knitting spools, so that it cannot be lowered down over this component, is readily attached to the knitting machine in its required position immediately above the circular operative arrangement of kniting stations. Moreover, and as will be subsequently described in detail, the positioning of the tubing chase is readily compatible with correspondingly positioning the lint-removal means supported on the chase in relation to the knitting stations so that the pressure air therefrom is effectively used to prevent the accummulation of, and the removal of lint.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
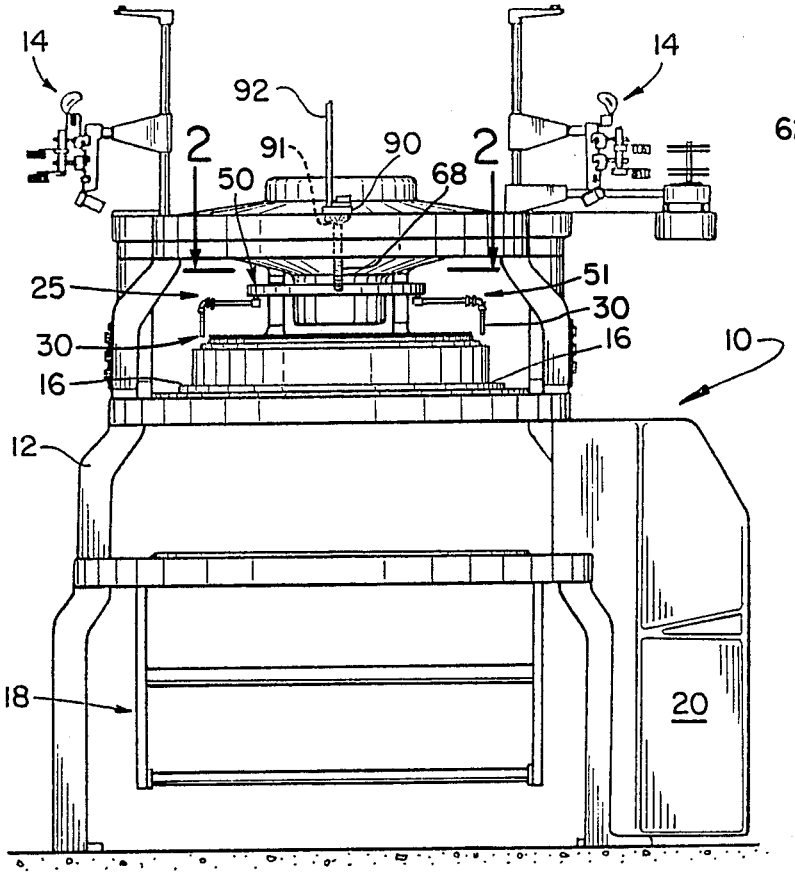
FIG. 1 is a front elevational view of a knitting machine of the type requiring the use of lint-removal blowers and using to advantage for said blowers a tubing chase according to the present invention.
Figure 5:
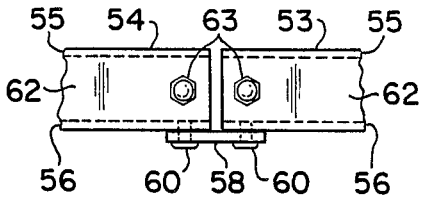
FIG. 5 is a sectional view, taken along line 5—5 of FIG. 2, showing further structural details of the tubing chase.

In FIG. 1 is shown, somewhat schematically, an overall view of a knitting maching of the type known in the trade as a double knit machine. Mounted on chasis frame 12 of the machine in "downstream" sequence is a yarn feed section 14, an array of knitting stations 16, and a lower section having a take-up roller mechanism 18 therein. Suitable controls and drive mechanisms are contained within cabinet section 20.

A problem of particular concern to the knitting industry is the accumulation of lint along the feed path of yarn used for knitting; i.e. the path from spool to knitting needle. Accumulation of lint sometimes results during the knitting of yarn into the fabric of lint slubs, thereby reducing the quality of the fabric. To correct this problem, various means of lint removal have been employed. Of particular interest in this case is an air delivery system 25 to blow away lint accumulation in the vicinity of the many knitting stations 16. Air delivery system 25 consists of an array of flutter tubes 30, a tubing chase 50, an air sequencer 90 and a remote compressed air supply 92.

To minimize drawing confusion in FIG. 1 and because they are well known as to both construction and operation, only two of the flutter tubes 30 and yarn feed positions 14 are shown. Suitable numbers of each are selected according to the model of the machine involved.

The functioning of the flutter tubes 30 is dependent upon a periodic supply of air from supply 92. In the arrangement of the air delivery system 25 shown in FIG. 1, compressed air is supplied to sequencer 90 where it is periodically directed to each of many tubings 52 that subsequently deliver air to each flutter tube 30. Serving as a conduit housing and support for piping arms 51 is the within inventive tubing chase 50, which is characterized by a construction which allows for an orderly, well organized and convenient installation of the air delivery system 25. Although ten sets of cooperating air delivery components are shown, this can vary since the number of flutter tubes 30, piping arms 51 and supply tubings 52 depends on the model of knitting machine 10 on which the air delivery system 25 is used.

Figure 4:
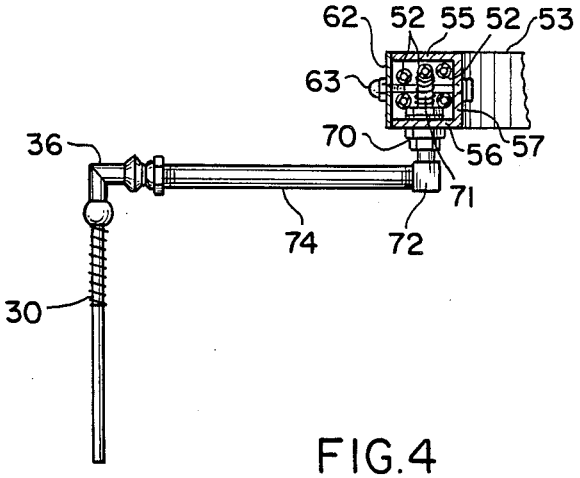
FIG. 4 is a detail sectional view, taken along line 4—4 of FIG. 2, of a pressure air delivery connection of one of the lint-removal blowers.
Figure 2:
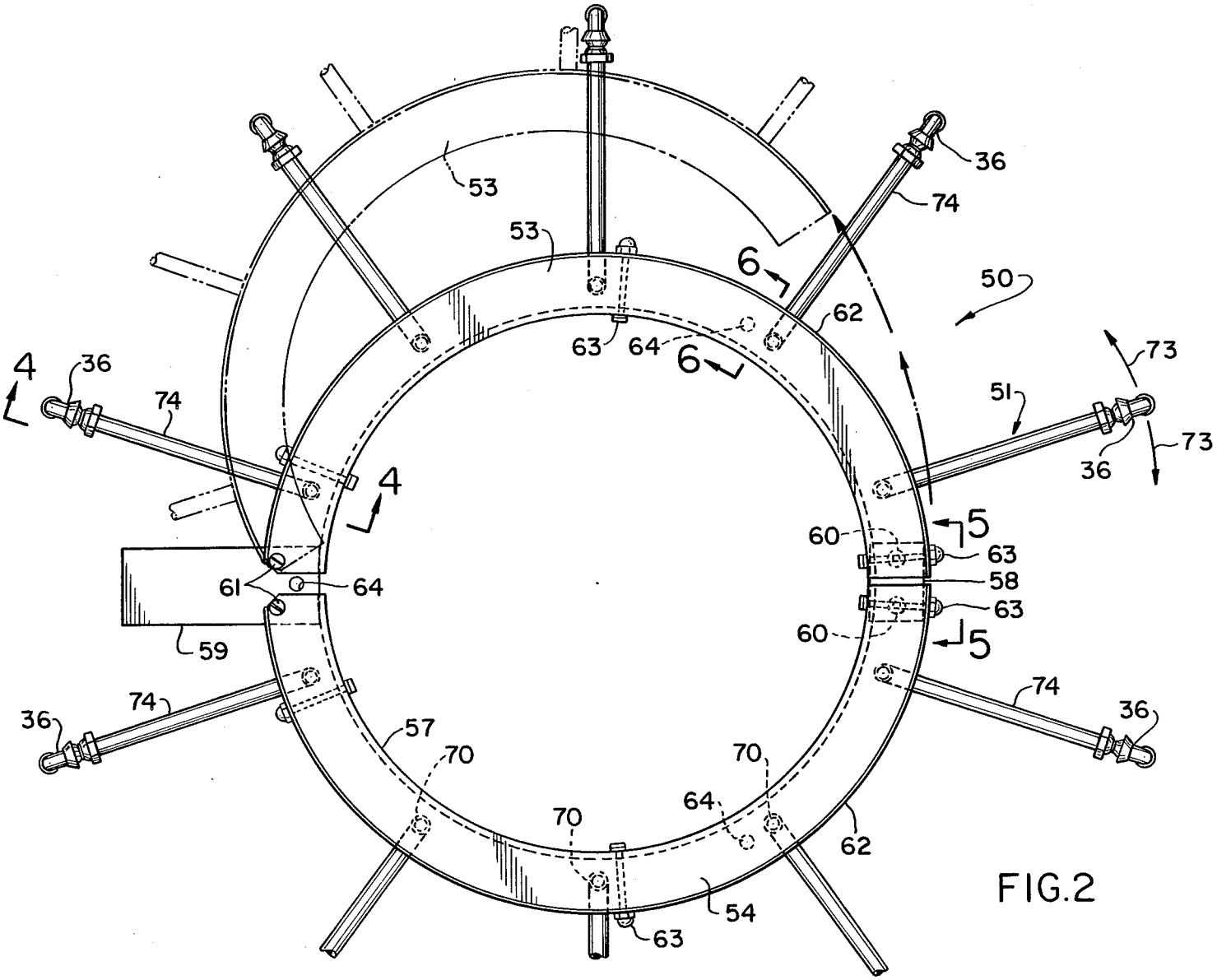
FIG. 2 is a plan view of the within inventive tubing chase in which portions thereof in phantom perspective illustrative its condition prior to assembly to the knitting machine, and the full line illustration is of the tubing chase in its attached condition to the knitting machine and as seen along line 2—2 of FIG. 1.

As perhaps is seen most clearly in FIG. 2, tubing chase 50 is comprised of a pair of semi-circular members 53 and 54. Each member 53 and 54 is "C" shaped in cross section, in an outwardly facing relation, having a top laterally extending or horizontal flange 55, a bottom horizontal flange 56, and an inside vertical wall 57, as illustrated in FIG. 4. Members 53 and 54 are maintained in the same horizontal plane by plates 58 and 59. Plate 58 is held to members 53 and 54 by screws 60, within tapped holes in flange 57. Likewise, plate 59 is held to members 53 and 54 by vertical through bolts 61. It should be noted at this point, that if one of the screws 60 is removed from plate 58, that the members 53 and 54 are then free to pivot relative to each other about bolts 61. This feature provides a significant convenience when the device 50 is to be installed or serviced on the double knit type machine 10.

Figure 6:
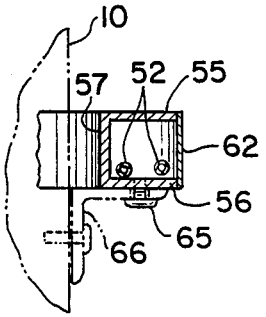
FIG. 6 is a sectional view, taken along line 6—6 of FIG. 2, illustrating a preferred manner of attaching the tubing chase to the knitting machine.

Closure means 62 for the outward opening of the members 53, 54 is provided in the form of two shaped, sheet metal covers, each held in place by through bolts 63, and when thusly installed essentially completes the body of chase 50. Three or more tapped holes 64 are provided in flange 57 and plate 59 to receive screws 65 to engage convenient mounting means 66 (FIG. 6) for firming up the attachment of chase 50 to the machine 10.

Figure 3:
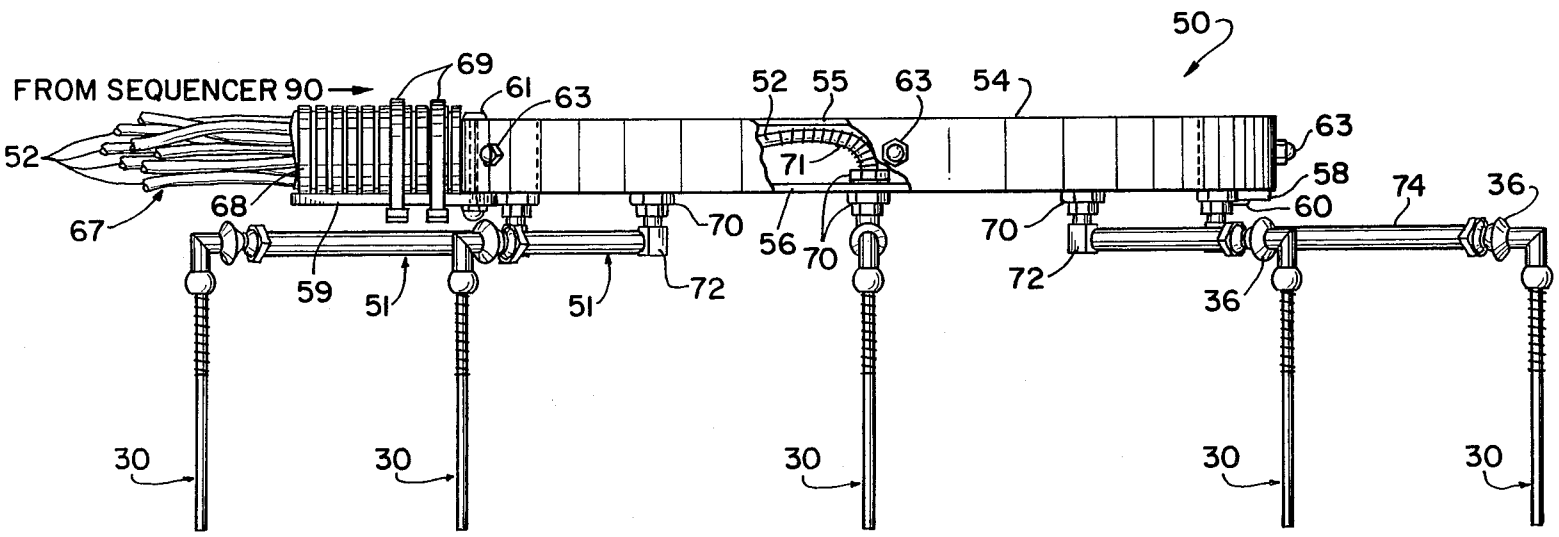
FIG. 3 is an isolated front elevational view, on an enlarged scale, of the tubing chase, with a portion broken away to illustrate internal structural features thereof.

In FIG. 3 is shown a bundle 67 of tubings 52 that originate at sequencer 90. Each tubing 52 will be understood to be connected to an outlet connector 91 (FIG. 1) of the sequencer 90. The set of tubings 67 is then gathered and enclosed in a protective shroud 68. (FIGS. 1 and 2). The downstream end of shroud 68 is anchored to the extend plate 59 on chase 50 with tie wraps 69. Each of the tubings 52 is led internally within chase 50, trimmed, and connected to its respective feed through fitting 70, ten of which named components are shown in FIG. 2, and will be understood to be equally spaced in circumferential relation about the lower flange 56 of segments 53 and 54. immediately adjacent the feed through fitting 70 is a spring like member 71 which is provided about tubing 52 to minimize any kinking in the tubings.

A multitude of piping arms 51 are suspended from feedthrough fittings 70 by right angle fittings 72 in radical fashion. Fittings 72 provide for angular adjustment 73 of each arm 51, should it be necessary. Flutter tubes 30 are each supported from a cooperating swivel fitting 36 which is screwed onto a length of pipe 74 which, in turn, is supported from a right angle fitting 72.

A further adjustment, should it be necessary, is a horizontal angular adjustment denoted by the arrows 73, and a lesser similar angular adjustment about each swivel fitting 36, both of which allow the operator the ability to aim the periodic discharge of compressed air from each flutter tube 30 directly at the site necessary for the effective removal of accumulated lint.

From the foregoing it should be readily appreciated that the tubing chase 50 is easily installed in a firm supported position on the knitting machine 10, and that this is accomplished within detracting from providing all of the necessary degrees of adjusting movement in the lint-removal blowers supported therefrom to enable these blowers to achieve their objective of preventing the accumulation of lint.

While the particular knitting machine tubing chase and method of installation herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. For a knitting machine of the type having an elevated circular support for knitting thread spools of a prescribed diameter and in a spaced relation therebelow a circular arrangement of knitting stations also of a prescribed diameter, a circular tubing chase of a lesser diameter than the aforesaid prescribed diameters adapted to be supportingly attached to said knitting maching in an interposed position between said knitting spools and knitting stations, said tubing chase comprising a cooperating pair of semi-circular housing members adapted to be interconnected to each other at opposite ends to define a completed circular assembly, each said housing member being of a c-shape in cross section defined by a vertically oriented wall and upper and lower walls extending laterally thereof so as to bound therebetween a storage compartment for plural pressure air tubes to be received therein, the operative position of each said housing member being a position in supported relation on said knitting machine by attachment means connecting each said housing member to a selected support surface of said knitting machine and said storage compartment in an outwardly facing relation with said upper and lower walls defining an opening into said storage compartment, plural pressure air tubes in a circular configuration having an operative position in said storage compartment after placement therein through said storage compartment opening, and a closure in the form of a vertically oriented wall bolted in place in the opening of said storage compartment, whereby interconnection of the housing members after closing movement about the knitting machine facilitates the attachments thereto.

2. The tubing chase for a knitting machine as claimed in claim 1 wherein one said interconnection of one of the cooperating opposite ends of said housing members is removable and the other is operatively effective to permit a pivotal traverse in one said housing member, to thereby contribute to facilitated installation of said tubing chase.

3. A tubing chase for a knitting machine as claimed in claim 2 including circumferentially spaced air delivery means supported in depending relation from said tubing chase to facilitate a directional discharge of pressure air therefrom at the knitting stations situated below said tubing chase.

* * * * *